US010082343B2

(12) United States Patent
Jin et al.

(10) Patent No.: US 10,082,343 B2
(45) Date of Patent: Sep. 25, 2018

(54) FIN FOR HEAT EXCHANGER AND HEAT EXCHANGER HAVING FIN

(71) Applicant: DANFOSS MICRO CHANNEL HEAT EXCHANGER (JIAXING) CO., LTD., Zhejiang (CN)

(72) Inventors: Junfeng Jin, Zhejiang (CN); Jing Yang, Zhejiang (CN); Jeffrey Lee Tucker, Zhejiang (CN); Jianlong Jiang, Zhejiang (CN); Xiangxun Lu, Zhejiang (CN); Hongbing Chen, Zhejiang (CN)

(73) Assignee: Danfoss Micro Channel Heat Exchanger (Jiaxing) Co., Ltd., Zhejiang (CN)

( * ) Notice: Subject to any disclaimer, the term of this patent is extended or adjusted under 35 U.S.C. 154(b) by 0 days.

(21) Appl. No.: 15/326,676

(22) PCT Filed: Jul. 16, 2015

(86) PCT No.: PCT/CN2015/084207

§ 371 (c)(1),
(2) Date: Jan. 17, 2017

(87) PCT Pub. No.: WO2016/008427

PCT Pub. Date: Jan. 21, 2016

(65) Prior Publication Data

US 2017/0198984 A1 Jul. 13, 2017

(30) Foreign Application Priority Data

Jul. 18, 2014 (CN) ..... 2014 1 0344189

(51) Int. Cl.
*F28D 1/02* (2006.01)
*F28F 1/12* (2006.01)
(Continued)

(52) U.S. Cl.
CPC ..... *F28F 1/126* (2013.01); *F28D 1/02* (2013.01); *F28D 7/16* (2013.01); *F28F 1/32* (2013.01);
(Continued)

(58) Field of Classification Search
CPC .... F28F 1/126; F28F 1/34; F28F 1/128; F28F 17/005; F28D 7/16; F28D 1/05366; F28D 1/05391; F02B 29/0462
(Continued)

(56) References Cited

U.S. PATENT DOCUMENTS 3,407,874 A 10/1968 Grier, Jr.
2005/0077033 A1* 4/2005 Schmalzried ..... F02B 29/0462 165/152

(Continued)

FOREIGN PATENT DOCUMENTS

CN 101619950 A 1/2010
CN 101672554 A 3/2010

(Continued)

OTHER PUBLICATIONS

International Search Report for PCT Serial No. PCT/CN2015/084207 dated Aug. 31, 2015.

(Continued)

*Primary Examiner* — Davis Hwu
(74) *Attorney, Agent, or Firm* — McCormick, Paulding & Huber LLP

(57) ABSTRACT

Disclosed are a fin (1) for a heat exchanger, and a heat exchanger having the fin (1). The fin (1) comprises a fin body (10) in a waveform structure formed by boards, wherein the fin body (10) has two first side surfaces (11) which are opposite one another in a first direction, two second side surfaces (12) which are opposite one another in a second direction, and wave crests and wave troughs, which
(Continued)

are on the second side surfaces (12); and the first direction and the second direction intersect. The fin body (10) comprises: a first concave portion (13), wherein the first concave portion (13) is formed in the fin body (10), and is located on the two first side surfaces (11) of the fin body (10). The fin (1) and the heat exchanger are manufactured more simply. Since the connection portions between the wave crests and wave troughs of the fin (1) are approximately perpendicular to a heat exchange tube (2), the condensed water is more easily discharged.

18 Claims, 8 Drawing Sheets

(51) Int. Cl.

| | |
|---|---|
| ***F28D 7/16*** | (2006.01) |
| ***F28F 17/00*** | (2006.01) |
| ***F28F 1/32*** | (2006.01) |
| *F25B 39/02* | (2006.01) |
| *F28D 1/047* | (2006.01) |

(52) U.S. Cl.
CPC ..... *F28F 17/005* (2013.01); *F25B 39/02* (2013.01); *F28D 1/0477* (2013.01); *F28F 2215/12* (2013.01)

(58) Field of Classification Search
USPC ..... 165/152
See application file for complete search history.

(56) References Cited

U.S. PATENT DOCUMENTS

| | | | | |
|---|---|---|---|---|
| 2005/0167088 | A1* | 8/2005 | Paulman ..... | F28F 1/126 165/152 |
| 2006/0157233 | A1* | 7/2006 | Ozaki ..... | F28F 1/128 165/152 |

FOREIGN PATENT DOCUMENTS

| | | | |
|---|---|---|---|
| CN | 104089517 | A | 10/2014 |
| CN | 203964745 | U | 11/2014 |
| EP | 1 696 196 | A1 | 8/2006 |
| EP | 2 532 998 | A1 | 12/2012 |
| JP | H09145282 | A | 6/1976 |
| JP | H10281673 | A | 10/1998 |
| JP | 2008170041 | A | 7/2008 |
| JP | 2011-89664 | A | 5/2011 |
| WO | 03081151 | A1 | 10/2003 |

OTHER PUBLICATIONS

Supplementary European Search Report for Serial No. EP 15 82 1294 dated Feb. 15, 2018.

* cited by examiner

FIN FOR HEAT EXCHANGER AND HEAT EXCHANGER HAVING FIN

CROSS-REFERENCE TO RELATED APPLICATION

This application is entitled to the benefit of and incorporates by reference subject matter disclosed in the International Patent Application No. PCT/CN2015/084207 filed on Jul. 16, 2015 and Chinese Patent Application No. 201410344189.6 filed on Jul. 18, 2014.

TECHNICAL FIELD

The present invention relates to a fin for a heat exchanger, and a heat exchanger having the fin.

BACKGROUND

Heat exchangers, such as micro-channel heat exchangers, tube-and-fin heat exchangers or parallel-flow evaporators, comprise fins and heat exchange tubes. The fins may be aluminum fins, etc., while the heat exchange tubes may be round tubes, oval tubes or flat tubes of copper or aluminium material.

SUMMARY

An object of the present invention is to provide a fin for a heat exchanger, and a heat exchanger having the fin, and to thereby improve a manufacturing process for example.

Another object of the present invention is to provide a fin for a heat exchanger, and a heat exchanger having the fin, and to thereby improve the water draining properties of the heat exchanger for example.

According to one aspect of the present invention, the present invention provides a fin for a heat exchanger, the fin comprising a fin main body formed as a waveform structure from a plate; the fin main body has two first side faces which are opposite each other in a first direction, two second side faces which are opposite each other in a second direction, and a wave crest and a wave trough on the second side faces; moreover, the first direction and the second direction intersect each other; the fin main body comprises: first recesses, which are formed in the fin main body and located on the two first side faces of the fin main body.

According to one aspect of the present invention, a heat exchange tube can be put into the first recess from one side and can perform heat transfer with the fin main body.

According to one aspect of the present invention, the fin main body also comprises: a second recess, which is formed in the fin main body and located on at least one of the two second side faces of the fin main body.

According to one aspect of the present invention, a heat exchange tube can be put into the second recess from one side and can perform heat transfer with the fin main body.

According to one aspect of the present invention, a part of the fin main body which lies between the wave crest and wave trough has a waveform shape or has a window.

According to one aspect of the present invention, a part of the fin main body which lies between the wave crest and wave trough has a protrusion.

According to one aspect of the present invention, the fin main body comprises water drainage holes which penetrate edge parts of the plate and are formed at the wave crest and wave trough; the water drainage holes are formed on the second side faces.

According to one aspect of the present invention, the first direction and second direction are substantially perpendicular to each other, or the first side face and second side face are substantially perpendicular to each other.

According to one aspect of the present invention, the present invention provides a heat exchanger comprising: a heat exchanger assembly, comprising: heat exchange tubes; and fins, the fin comprising a fin main body formed as a waveform structure from a plate; the fin main body has two first side faces which are opposite each other in a first direction, two second side faces which are opposite each other in a second direction, and a wave crest and a wave trough on the second side faces; moreover, the first direction and the second direction intersect each other; the fin main body comprises: first recesses, which are formed in the fin main body and located on the two first side faces of the fin main body; wherein multiple heat exchange tubes and fins are arranged alternately in a row in such a way that first side faces of the fin main bodies of adjacent fins are adjacent to each other, thereby forming the heat exchanger assembly; the heat exchange tubes are located in the first recesses.

According to one aspect of the present invention, the fin main body also comprises: a second recess, which is formed in the fin main body and located on at least one of the two second side faces of the fin main body; another heat exchange tube is provided in the second recess of the heat exchanger assembly, on at least one of the two second side faces of the fin main body.

According to one aspect of the present invention, the fin main body also comprises: a second recess, which is formed in the fin main body and located on at least one of the two second side faces of the fin main body; another heat exchange tube is provided between two heat exchanger assembly rows, the other heat exchange tube being located in the second recess.

According to one aspect of the present invention, the fin main body also comprises: second recesses, which are formed in the fin main body and located on the second side faces of the fin main body; multiple heat exchanger assembly rows are arranged alternately with other heat exchange tubes located in the second recesses.

According to one aspect of the present invention, the present invention provides a heat exchanger comprising: a heat exchanger assembly, comprising: heat exchange tubes; and fins, the fin comprising a fin main body formed as a waveform structure from a plate; the fin main body has two first side faces which are opposite each other in a first direction, two second side faces which are opposite each other in a second direction, and a wave crest and a wave trough on the second side faces; moreover, the first direction and the second direction intersect each other; the fin main body comprises: a first recess, which is formed in the fin main body and located on at least one of the two first side faces of the fin main body; wherein multiple fins are arranged alternately in a row in such a way that second side faces of the fin main bodies of adjacent fins are adjacent to each other, and the heat exchange tube is located in the first recess on at least one of the two first side faces.

According to one aspect of the present invention, the fin main body also comprises: a second recess, which is formed in the fin main body and located on at least one of the two second side faces of the fin main body.

According to one aspect of the present invention, the fin main body also comprises: second recesses, which are formed in the fin main body and located in the two second side faces of the fin main body; other heat exchange tubes are provided in the second recesses of the fin main bodies of the fins, such that fins and other heat exchange tubes are arranged alternately.

According to one aspect of the present invention, a heat exchange tube can be put into the first recess from one side and can perform heat transfer with the fin main body.

According to one aspect of the present invention, another heat exchange tube can be put into the second recess from one side and can perform heat transfer with the fin main body.

According to one aspect of the present invention, the present invention provides a fin for a heat exchanger, the fin comprising a fin main body formed as a waveform structure from a plate; the fin main body has two first side faces which are opposite each other in a first direction, two second side faces which are opposite each other in a second direction, and a wave crest and a wave trough on the second side faces; moreover, the first direction and the second direction intersect each other; the fin main body comprises: a first recess, which is formed in the fin main body and located on at least one of the two first side faces of the fin main body; and second recesses, which are formed in the fin main body and located on the two second side faces of the fin main body.

According to one aspect of the present invention, the present invention provides a heat exchanger comprising: a heat exchanger assembly, comprising: heat exchange tubes; and fins, the fin comprising a fin main body formed as a waveform structure from a plate; the fin main body has two first side faces which are opposite each other in a first direction, two second side faces which are opposite each other in a second direction, and a wave crest and a wave trough on the second side faces; moreover, the first direction and the second direction intersect each other; the fin main body comprises: a first recess, which is formed in the fin main body and located on at least one of the two first side faces of the fin main body; and second recesses, which are formed in the fin main body and located on the two second side faces of the fin main body; wherein multiple heat exchange tubes and fins are arranged alternately in a row in such a way that second side faces of the fin main bodies of adjacent fins are adjacent to each other, thereby forming the heat exchanger assembly; the heat exchange tubes are located in the second recesses.

According to one aspect of the present invention, another heat exchange tube is provided in the first recess of the fin of the heat exchanger assembly, on at least one of the two first side faces of the fin main body.

According to one embodiment of the present invention, the first recesses are located on the two first side faces of the fin main body; and multiple heat exchanger assembly rows are arranged alternately with other heat exchange tubes located in the first recesses.

The fin and heat exchanger according to the present invention are simpler to manufacture, and since the connecting part between the wave crest and wave trough of the fin is substantially perpendicular to the heat exchange tube, condensed water is discharged more easily.

DETAILED DESCRIPTION

Figure 1:
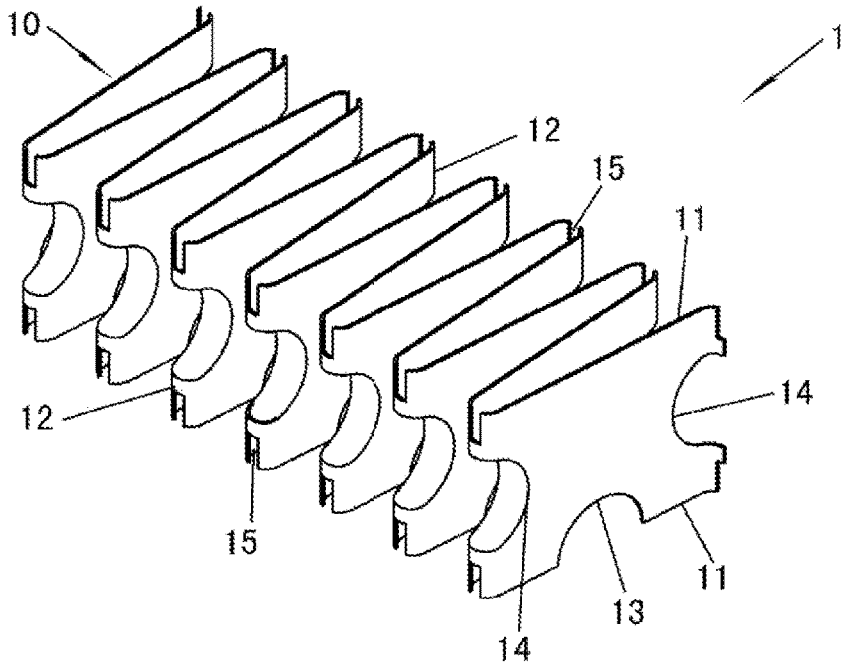
FIG. 1 is a schematic perspective drawing of a fin according to an embodiment of the present invention.

The present invention is explained further below in conjunction with the accompanying drawings and particular embodiments.

Referring to FIGS. 1, 4, 5 and 12, a fin 1 according to an embodiment of the present invention comprises a fin main body 10 formed as a waveform structure from a plate; the fin main body has two first side faces 11 which are opposite each other in a first direction, two second side faces 12 which are opposite each other in a second direction, and a wave crest and a wave trough on the second side faces 12; moreover, the first direction and the second direction intersect each other. The fin main body 10 comprises: a first recess 13, which is formed in the fin main body 10 and located on at least one of the two first side faces 11 of the fin main body 10; and second recesses 14, which are formed in the fin main body 10 and located on the two second side faces 12 of the fin main body 10.

According to another embodiment of the present invention, as shown in FIG. 1, a fin 1 for a heat exchanger according to an embodiment of the present invention comprises a fin main body 10 formed as a waveform structure from a plate; the fin main body 10 has two first side faces 11 which are opposite each other in a first direction, two second side faces 12 which are opposite each other in a second direction, and a wave crest and a wave trough on the second side faces 12; moreover, the first direction and the second direction intersect each other. The fin main body 10 comprises: a first recess 13, which is formed in the fin main body 10 and located on two first side faces 11 or one first side face 11 of the fin main body 10. Referring to FIGS. 4 to 18, a heat exchange tube 2 can be put into the first recess 13 from one side and can perform heat transfer with the fin main body 10. The plate may be an aluminium plate, etc.

As FIG. 1 shows, the fin main body 10 may also comprise a second recess 14, which is formed in the fin main body 10 and located on at least one of the two second side faces 12 of the fin main body 10. Referring to FIGS. 4 to 18, a heat exchange tube 2 can be put into the second recess 14 from one side and can perform heat transfer with the fin main body 10. The first direction and second direction may be substantially perpendicular to each other, or the first side face 11 and the second side face 12 may be substantially perpendicular to each other.

The recess may be formed by edge folding or by removing material. The recess is designed to be able to partially or mostly cover the periphery of the heat exchange tube.

Figure 2:
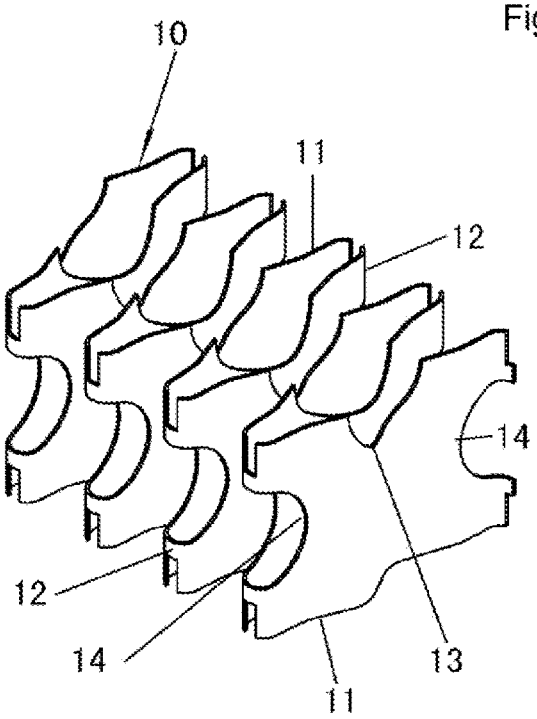
FIG. 2 is a schematic perspective drawing of a fin according to another embodiment of the present invention.
Figure 3:
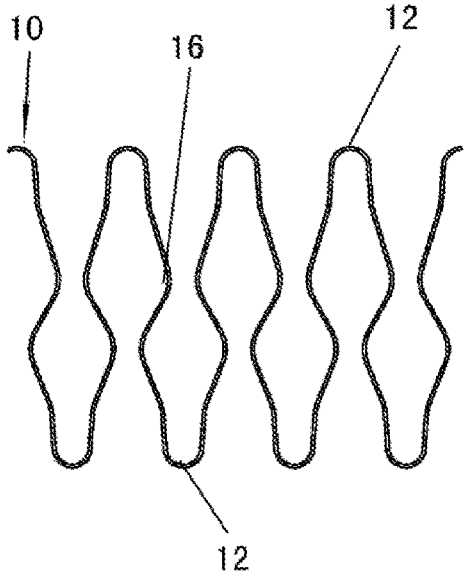
FIG. 3 is a schematic top view of a fin according to another embodiment of the present invention.

Referring to FIGS. 2 and 3, a part of the fin main body 10 which lies between the wave crest and the wave trough may have a waveform shape or a window, but of course may also be in the form of a flat plate. As FIG. 3 shows, a part of the fin main body 10 which lies between the wave crest and the wave trough may have a protrusion 16. The waveform structure, or the protrusion such as an arcuate or rectangular projection, increases perturbation of airflow, increasing fin heat exchange efficiency. Depending on the fin arrangement and the direction of airflow, the window and projection may be arranged to be substantially perpendicular to the direction of airflow, so as to increase perturbation of airflow, and further improve the fin heat exchange efficiency.

Referring to FIGS. 1-2, the fin main body 10 may comprise water drainage holes 15 which penetrate edge parts of the plate and are formed at the wave crest and wave trough; the water drainage holes 15 are formed on the second side faces 12. The water drainage holes allow condensed water to flow smoothly downwards, to reduce airflow resistance or reduce fin weight, etc.

Referring to FIGS. 1, 4, 5 and 12, the heat exchanger according to an embodiment of the present invention comprises: a heat exchanger assembly, comprising: heat exchange tubes 2; and fins 1, the fin 1 comprising a fin main body 10 formed as a waveform structure from a plate, the fin main body 10 having two first side faces 11 which are opposite each other in a first direction, two second side faces 12 which are opposite each other in a second direction, and a wave crest and a wave trough on the second side faces 12; moreover, the first direction and the second direction intersect each other. The fin main body comprises: a first recess 13, which is formed in the fin main body 10 and located on at least one of the two first side faces 11 of the fin main body 10; and second recesses 14, which are formed in the fin main body 10 and located on the two second side faces 12 of the fin main body 10. Multiple heat exchange tubes 2 and fins 1 are arranged alternately in a row in such a way that second side faces 12 of the fin main bodies 10 of adjacent fins 1 are adjacent to each other, thereby forming the heat exchanger assembly; the heat exchange tubes 2 are located in the second recesses 14. Another heat exchange tube may be provided in the first recess 13 of the fin 1 of the heat exchanger assembly, in at least one of the two first side faces 11 of the fin main body 10. According to some embodiments of the present invention, the first recess 13 is located on two first side faces 11 of the fin main body 10; and multiple heat exchanger assembly rows are arranged alternately with other heat exchange tubes 2 located in the first recesses 11.

Figure 4:
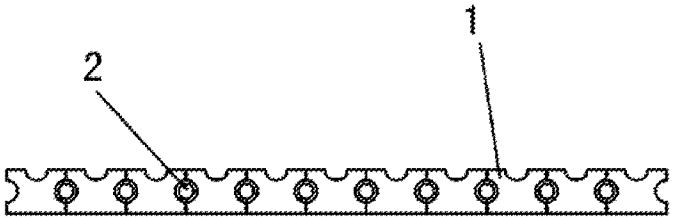
FIG. 4 is a schematic main view of a single-row heat exchanger according to an embodiment of the present invention.
Figure 5:
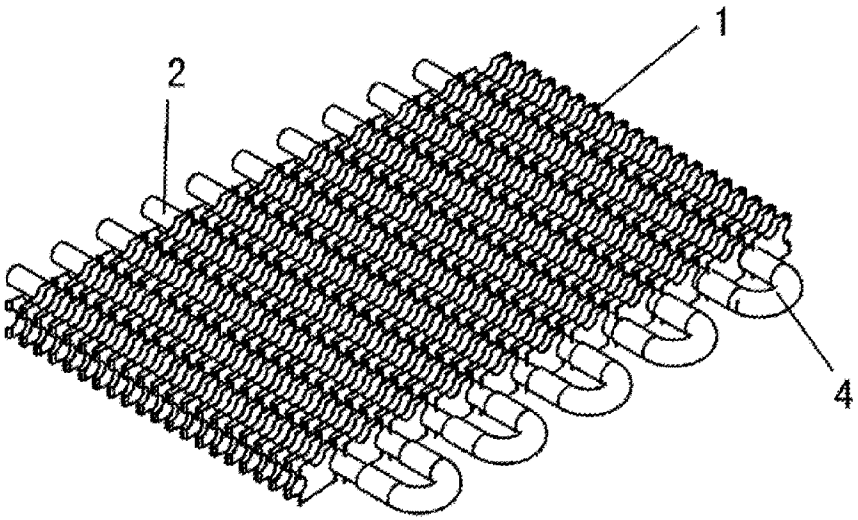
FIG. 5 is a schematic perspective drawing of a single-row heat exchanger according to an embodiment of the present invention.
Figure 12:
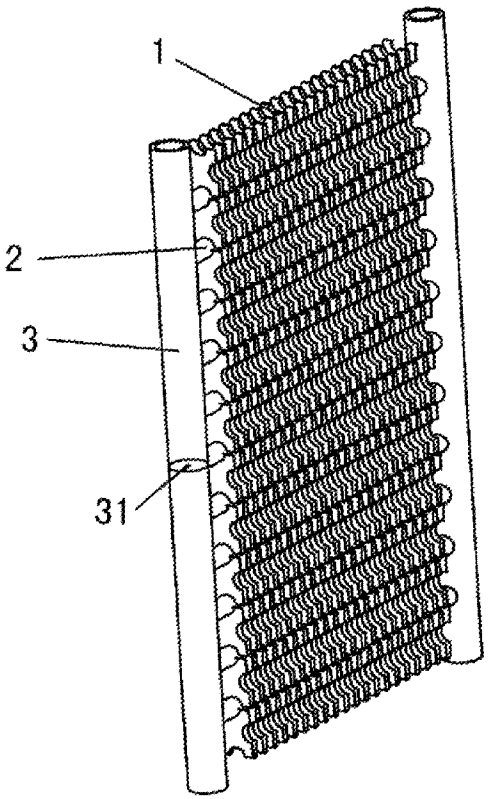
FIG. 12 is a schematic perspective drawing of a single-row heat exchanger according to another embodiment of the present invention.

In some embodiments of the present invention, as shown in FIGS. 1, 4, 5 and 12, the heat exchanger according to an embodiment of the present invention comprises: a heat exchanger assembly comprising: a heat exchange tube 2; and a fin 1 comprising a fin main body 10 formed as a waveform structure from a plate, the fin main body 10 comprising: a first recess 13, which is formed in the fin main body 10 and located on at least one of two first side faces 11 of the fin main body 10. The fin main body 10 also comprises: second recesses 14, which are formed in the fin main body 10 and located on two second side faces 12 of the fin main body 10. Multiple heat exchange tubes 2 and fins are arranged alternately in a row in such a way that second side faces 12 of the fin main bodies 10 of adjacent fins are adjacent to each other, thereby forming a heat exchanger assembly; the heat exchange tubes 2 are located in the second recesses 14. The heat exchanger may comprise a bend 4. The heat exchange tubes 2 may be ordinary round tubes and connected by bends 4. The heat exchange tube 2 is used for circulating refrigerant, and multiple loops are formed in the heat exchanger by providing different bends or headers (as shown in FIG. 12). The second recesses 14 are used to enclose the heat exchange tubes 2. When the heat exchanger is used as a single-row heat exchanger, as shown in FIGS. 4, 5 and 12, unused recesses are notches with a part cut away, and can effectively reduce fin weight and airflow resistance.

Figure 6:
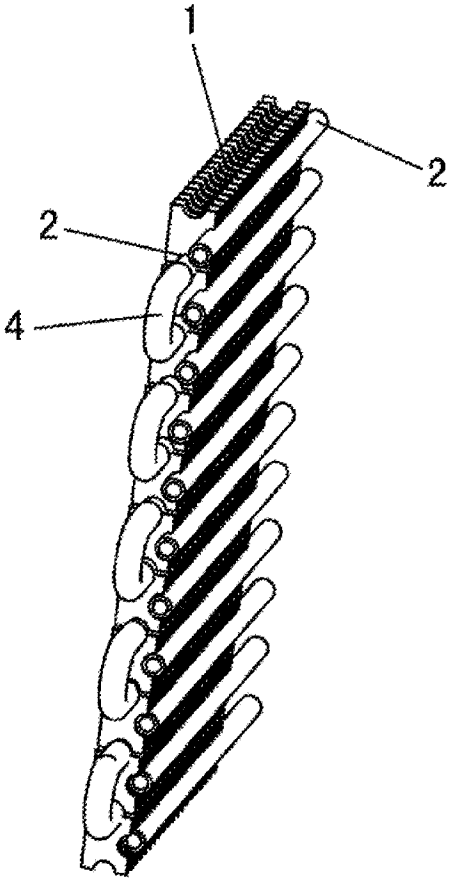
FIG. 6 is a schematic perspective drawing of a two-row heat exchanger according to an embodiment of the present invention.

As shown in FIG. 6, another heat exchange tube 2 may be disposed in the first recess 13 in at least one of the two first side faces 11. That is, a row of heat exchange tubes 2 may be added to the heat exchanger assembly or heat exchanger shown in FIG. 4, 5 or 12 to form a two-row heat exchanger. When both first side faces 11 of the fin have a first recess 13, heat exchange tubes 2 may be added at the first recesses 13 on the two first side faces 11 to form a two-row or multiple-row heat exchanger.

Figure 8:
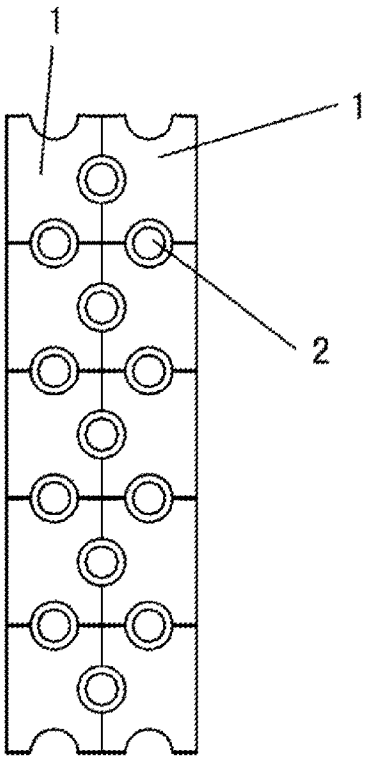
FIG. 8 is a schematic main view of a three-row heat exchanger according to an embodiment of the present invention.
Figure 7:
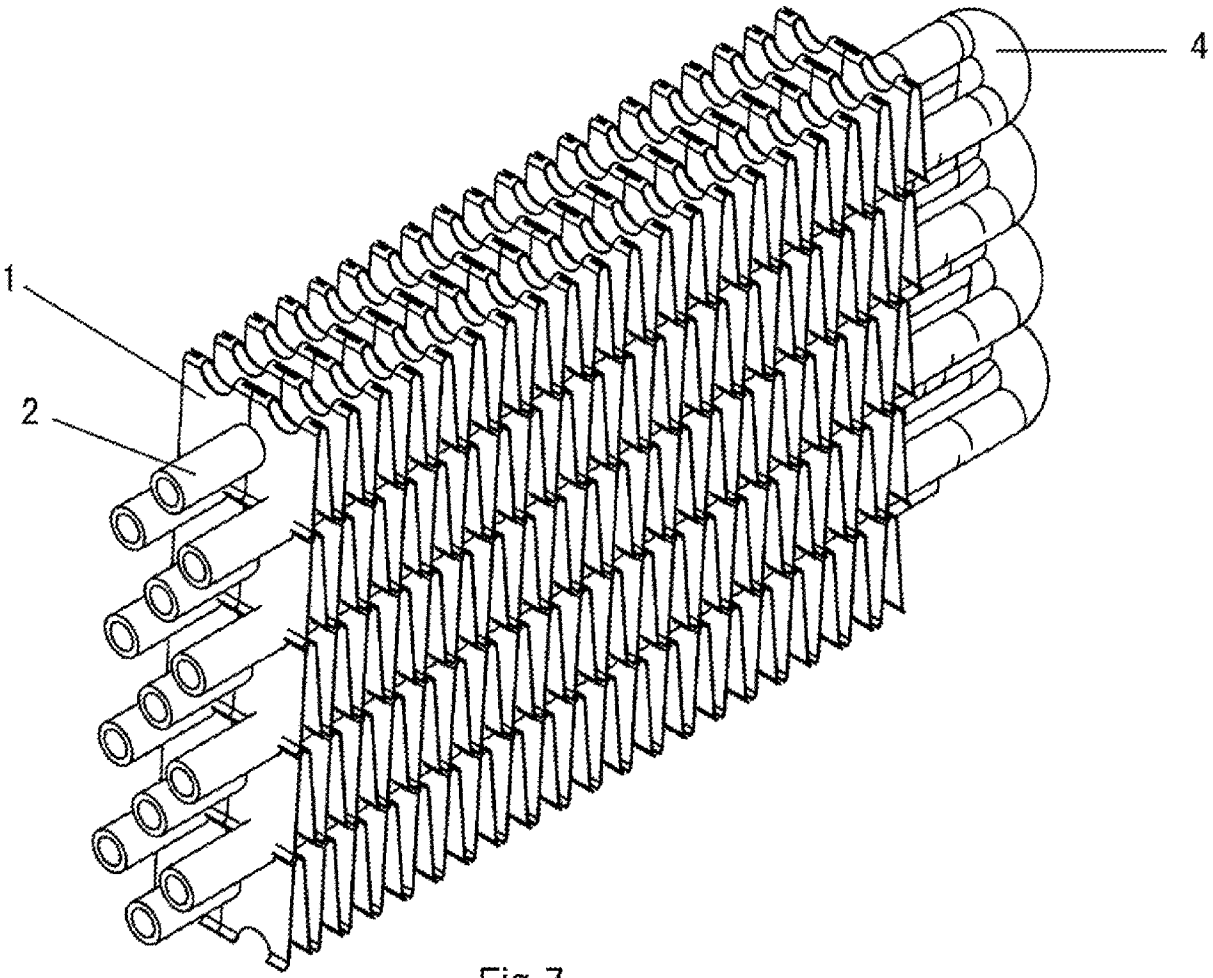
FIG. 7 is a schematic perspective drawing of a three-row heat exchanger according to an embodiment of the present invention.

As FIGS. 7 and 8 show, multiple heat exchanger assembly rows are arranged alternately with other heat exchange tubes 2 located in the second recesses 14. For example, other heat exchange tubes 2 are provided between the heat exchanger assembly or heat exchanger shown in FIG. 4, 5 or 12, the other heat exchange tubes 2 being located in the second recesses 14. That is, two rows of heat exchange tubes and one row of fins may be added to the heat exchanger assembly or heat exchanger shown in FIG. 4, 5 or 12 to form a three-row heat exchanger. Extending this principle, a multiple-row heat exchanger may be formed.

Figure 10:
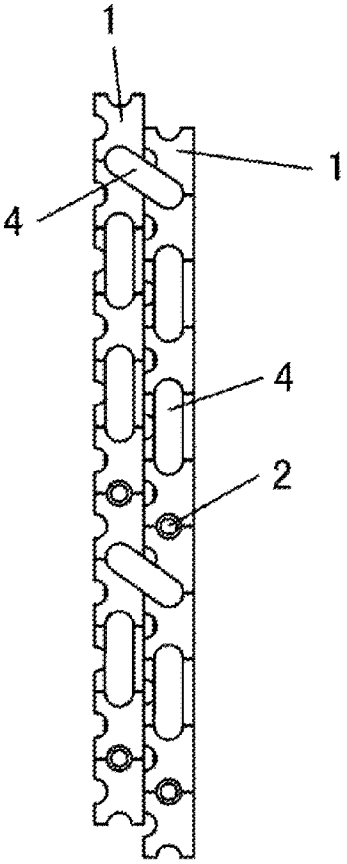
FIG. 10 is a schematic main view of a multiple-row heat exchanger according to an embodiment of the present invention.
Figure 9:
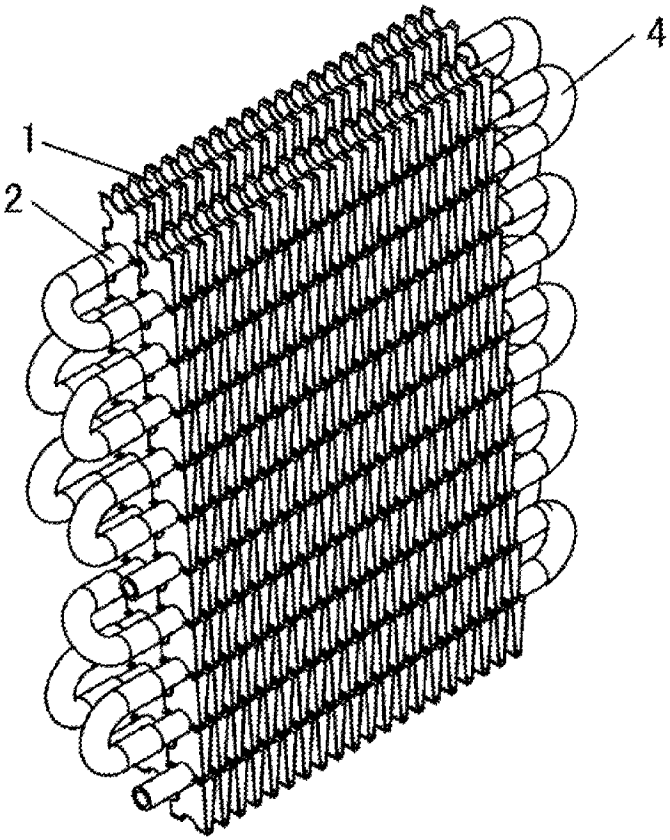
FIG. 9 is a schematic perspective drawing of a multiple-row heat exchanger according to an embodiment of the present invention.
Figure 11:
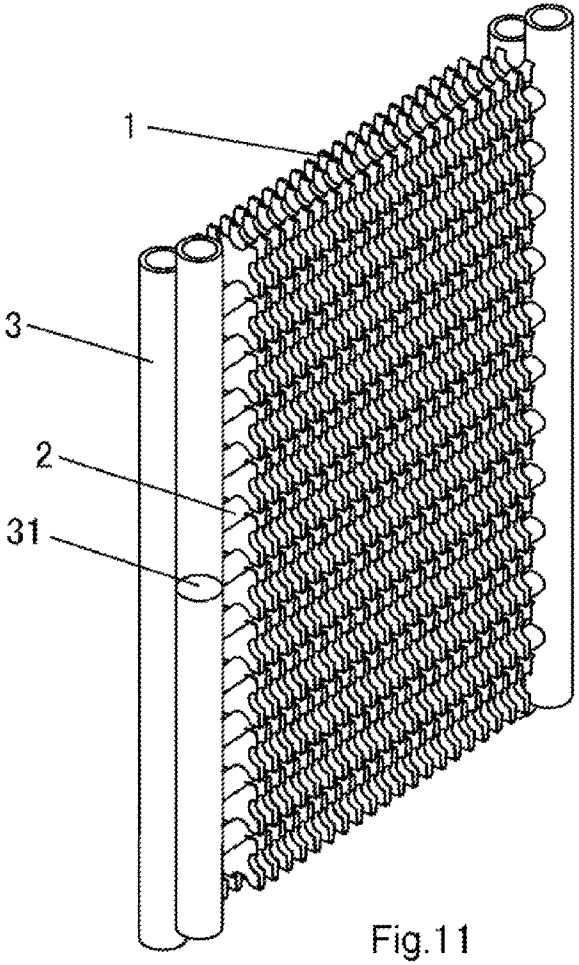
FIG. 11 is a schematic main view of a multiple-row heat exchanger according to another embodiment of the present invention.

As shown in FIGS. 9, 10 and 11, two single-row heat exchangers such as that shown in FIGS. 4 and 5 may be fitted together to form a two-row or multiple-row heat exchanger. As FIGS. 9 and 10 show, the multiple-row heat exchanger may comprise bends 4. As FIG. 11 shows, the multiple-row heat exchanger may comprise headers 3 and a baffle plate 31.

As shown in FIG. 12, the heat exchanger comprises headers 3 and a baffle plate 31. The heat exchange tubes 2 of the heat exchanger may be ordinary round tubes. The heat exchange tubes 2 are used for circulating refrigerant, and multiple loops are formed in the heat exchanger through the provision of the baffle plate 31.

Figures 13, 14, 15:
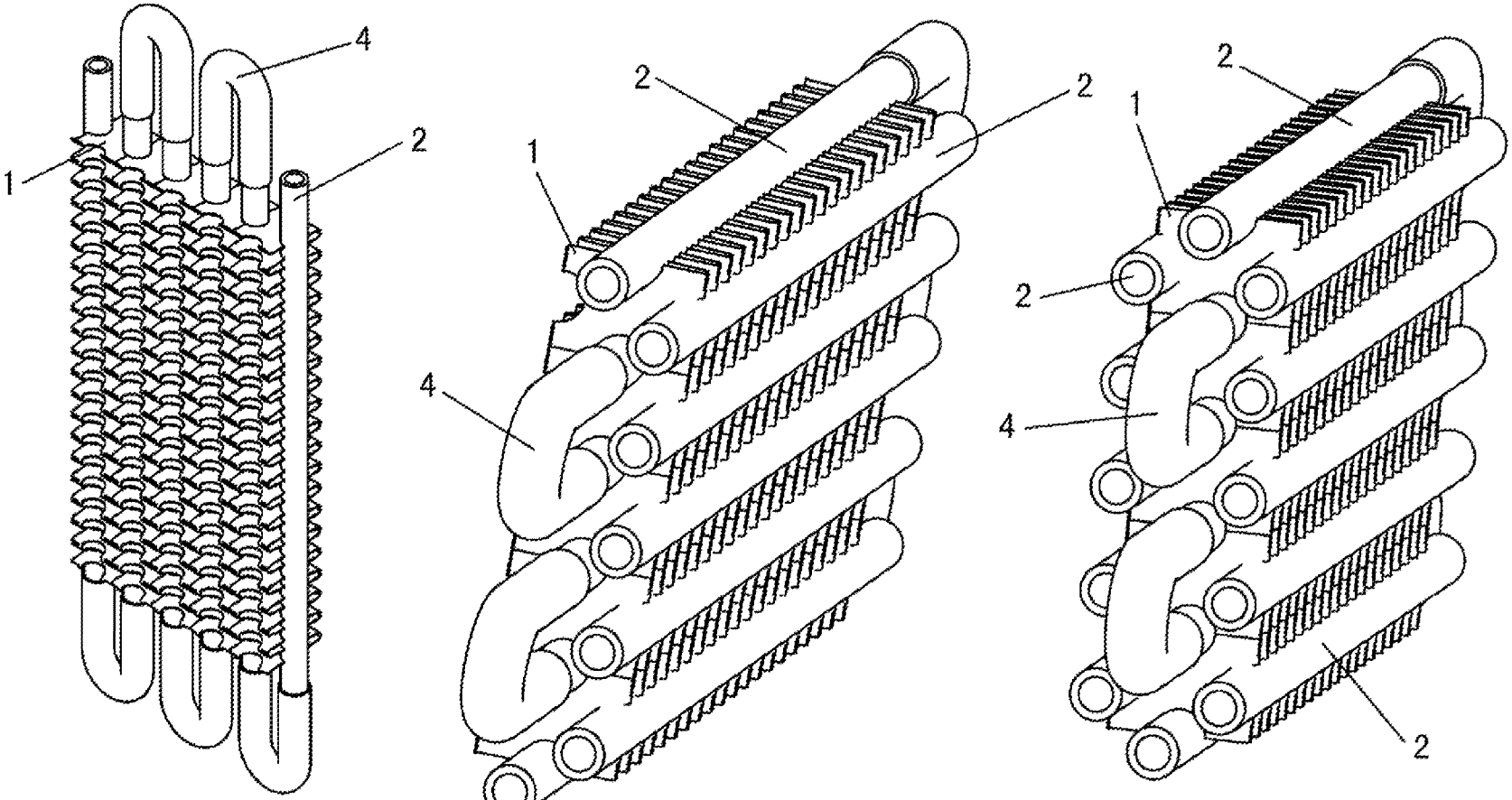
FIG. 13 is a schematic perspective drawing of a single-row heat exchanger according to another embodiment of the present invention.
FIG. 14 is a schematic perspective drawing of a two-row heat exchanger according to another embodiment of the present invention.
FIG. 15 is a schematic perspective drawing of a three-row heat exchanger according to another embodiment of the present invention.

As FIGS. 1 and 13 show, the heat exchanger according to an embodiment of the present invention comprises: a heat exchanger assembly comprising: heat exchange tubes 2; and fins 1, the fin 1 comprising a fin main body 10 formed as a waveform structure from a plate; the fin main body 10 has two first side faces 11 which are opposite each other in a first direction, two second side faces 12 which are opposite each other in a second direction, and a wave crest and a wave trough on the second side faces 12; moreover, the first direction and the second direction intersect each other. The fin main body 10 comprises: first recesses 13, which are formed in the fin main body 10 and located on the two first side faces 11 of the fin main body 10. Multiple heat exchange tubes 2 and fins are arranged alternately in a row in such a way that first side faces 11 of the fin main bodies 10 of adjacent fins are adjacent to each other, thereby forming a heat exchanger assembly; the heat exchange tubes 2 are located in the first recesses 13.

In the case of the heat exchanger according to the abovementioned embodiment of the present invention, since the first recesses 13 are formed in the fin main body 10 and located on the two first side faces 11 of the fin main body 10, manufacture is simpler, and since the part of the fin main body 10 which lies between the fin wave crest and wave trough or between the second side faces 12 is perpendicular to the heat exchange tube 2, e.g. a round tube, condensed water is drained more easily.

Referring to FIGS. 1, 13, 14 and 15, the fin main body 10 may also comprise: a second recess 14, which is formed in the fin main body 10 and located on at least one of the two second side faces 12 of the fin main body 10. Another heat exchange tube 2 is provided in the second recess 14 of the heat exchanger assembly, on at least one of the two second side faces 12 of the fin main body 10.

According to another embodiment of the present invention, another heat exchange tube 2 is provided between two heat exchanger assembly rows, the other heat exchange tube 2 being located in the second recess 14.

According to another embodiment of the present invention, referring to FIGS. 1 and 13, the fin main body 10 also comprises: second recesses 14, which are formed in the fin main body 10 and located on two second side faces 12 of the fin main body 10. Multiple heat exchanger assembly rows are arranged alternately with other heat exchange tubes 2, the other heat exchange tubes 2 being located in the second recesses 14.

As FIGS. 14 and 15 show, when the second side face 12 is provided with a second recess 14, when the heat exchanger is used as a single-row heat exchanger, and when unused second recesses 14 are gouged-out notches, the fin weight may be reduced effectively, and the airflow resistance may be reduced. Furthermore, when only one second side face 12 has a second recess 14, a row of heat exchange tubes may be added to form a two-row heat exchanger, and when both second side faces 12 have a second recess 14, two rows of heat exchange tubes may be added to form a three-row heat exchanger. Extending this principle, a multiple-row heat exchanger may be formed.

Figure 17:
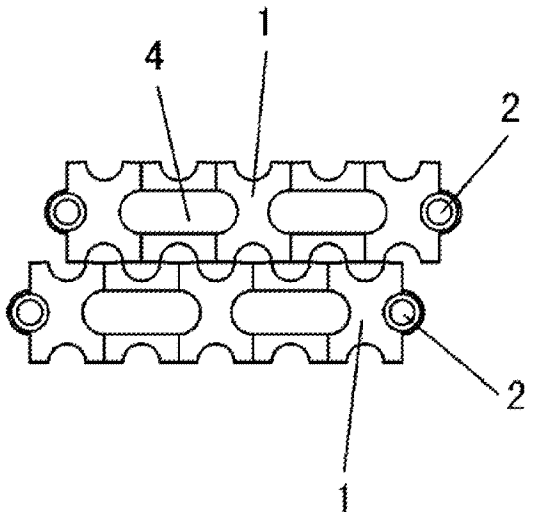
FIG. 17 is a schematic main view of a multiple-row heat exchanger according to another embodiment of the present invention.
Figure 16:
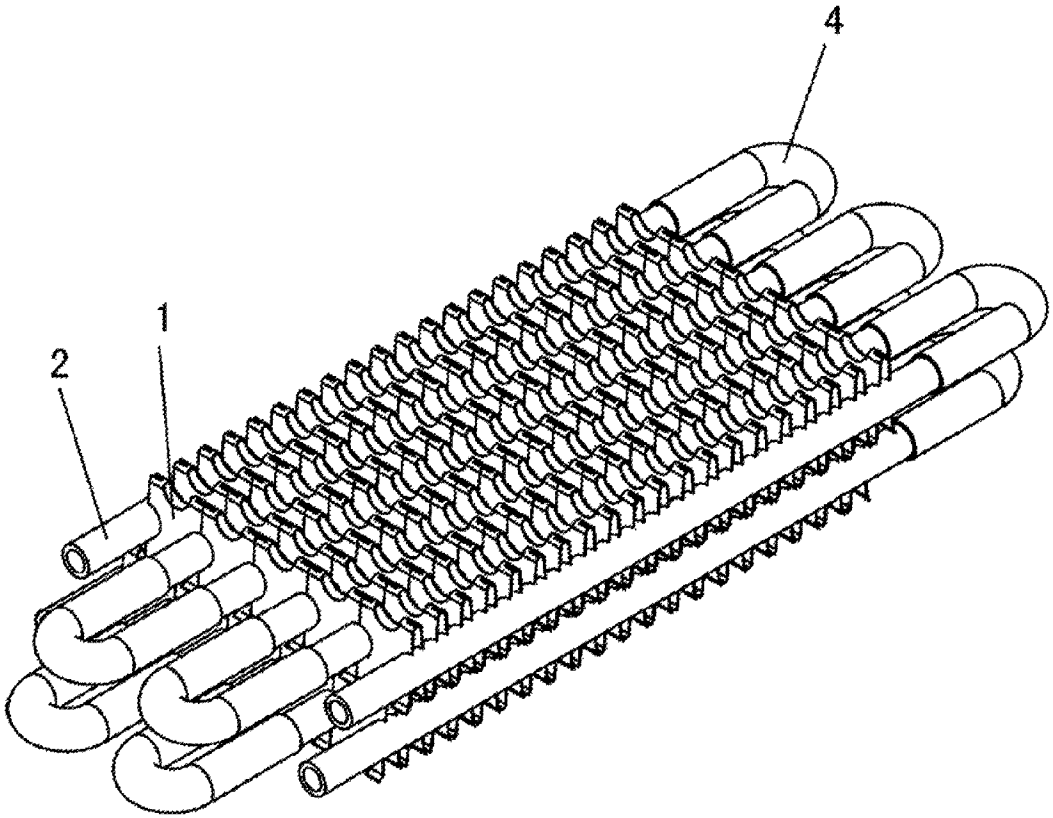
FIG. 16 is a schematic perspective drawing of a multiple-row heat exchanger according to another embodiment of the present invention.

As shown in FIGS. 16 and 17, two single-row heat exchangers may be fitted together to form a two-row or multiple-row heat exchanger.

Figure 18:
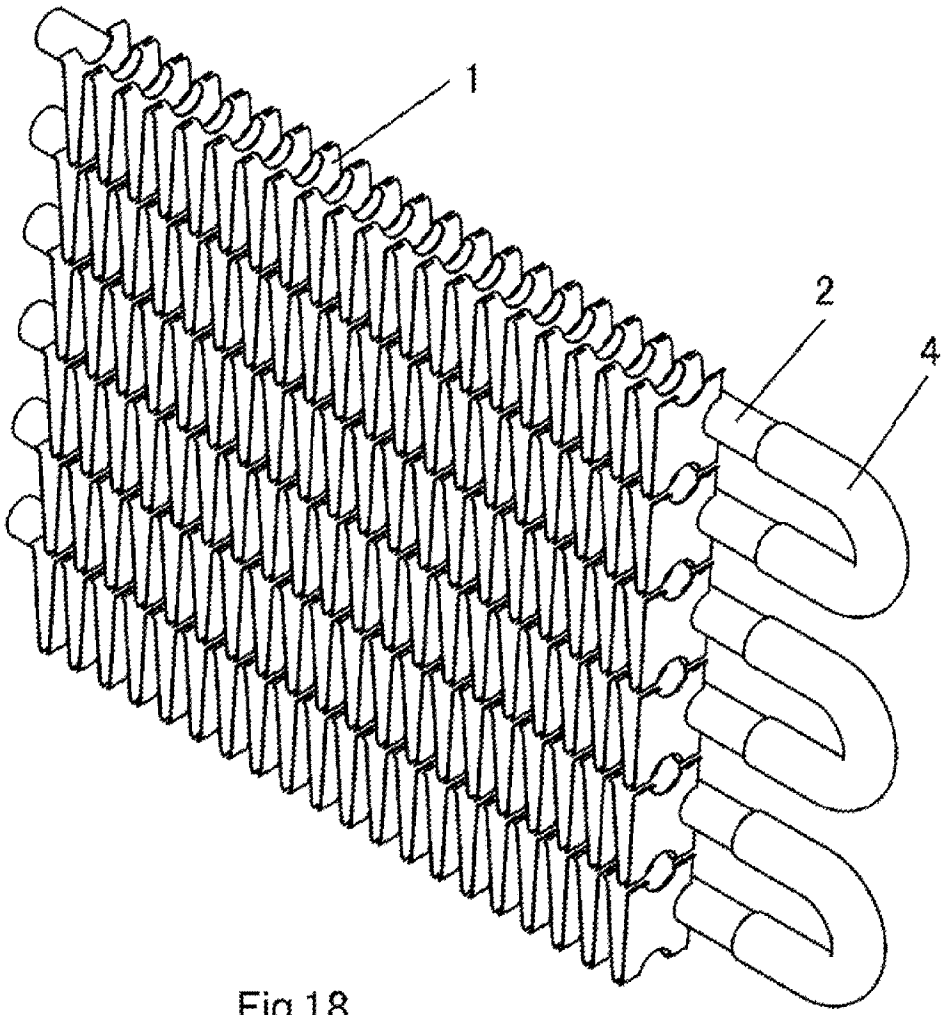
FIG. 18 is a schematic perspective drawing of a single-row heat exchanger according to another embodiment of the present invention.

Referring to FIGS. 1 and 18, the heat exchanger according to an embodiment of the present invention comprises: a heat exchanger assembly, comprising: heat exchange tubes 2; and fins 1, the fin 1 comprising a fin main body 10 formed as a waveform structure from a plate, the fin main body 10 having two first side faces 11 which are opposite each other in a first direction, two second side faces 12 which are opposite each other in a second direction, and a wave crest and a wave trough on the second side faces 12; moreover, the first direction and the second direction intersect each other. The fin main body 10 comprises: a first recess 13, which is formed in the fin main body 10 and located on at least one of the two first side faces 11 of the fin main body 10. Multiple fins are arranged alternately in a row in such a way that second side faces 12 of the fin main bodies 10 of adjacent fins are adjacent to each other, and the heat exchange tube 2 is located in the first recess 13 on at least one of the two first side faces 11.

Referring to FIGS. 1 and 18, the fin main body 10 may also comprise: a second recess 14, which is formed in the fin main body 10 and located on at least one of the two second side faces 12 of the fin main body 10.

Referring to FIGS. 1 and 18, according to some embodiments, the fin main body 10 also comprises: second recesses 14, which are formed in the fin main body 10 and located in two second side faces 12 of the fin main body 10. Other heat exchange tubes 2 are provided in the second recesses 14 of the fin main bodies 10 of the fins, such that fins and other heat exchange tubes 2 are arranged alternately.

Referring to FIGS. 1 and 18, the heat exchanger also comprises bends 4. When the heat exchanger is used as a single-row heat exchanger, and when unused second recesses 14 are gouged-out notches, the fin weight can be reduced effectively; the second recesses 14 between fins avoid adhesion during brazing. Furthermore, when the two first side faces 11 are provided with first recesses 13, a row of heat exchange tubes 2 may be added to form a two-row heat exchanger, or a multiple-row heat exchanger may be formed by adding fins 1 and heat exchange tubes 2.

The heat exchanger according to the abovementioned embodiment has lower contact thermal resistance, because a conventional copper tube and fin heat exchanger employs mechanical tube expansion to achieve tight contact between the copper tubes and fins, so the contact thermal resistance is higher than in the case of the fins and round tubes according to an embodiment of the present invention, where brazing is employed. Compared with a conventional copper tube and fin heat exchanger, the heat exchanger in an embodiment of the present invention has lower material costs and a lower heat exchanger weight. The heat exchanger structure of the present invention is suitable for use with round tubes of various diameters. In particular, due to the restrictions of mechanical tube expansion technology at the present stage, compared with a conventional small-diameter copper tube and fin heat exchanger, the heat exchanger structure or design of the present invention has a more obvious advantage in the case of small tube diameters. Furthermore, in the heat exchanger structure of the present invention, the number of loops and heat exchange tube rows can be set flexibly and variably according to different application scenarios.

It must be explained that some or all of the technical features of the embodiments above may be combined to form new embodiments.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A fin for a heat exchanger, the fin comprising a fin main body formed as a waveform structure from a plate; the fin main body has two first side faces which are opposite each other in a first direction, two second side faces which are opposite each other in a second direction, and a wave crest and a wave trough on the second side faces; moreover, the first direction and the second direction intersect each other;

the fin main body comprises: first recesses, which are formed in the fin main body and located on the two first side faces of the fin main body, and a second recess, which is formed in the fin main body and located on at least one of the two second side faces of the fin main body;

wherein the fin main body waveform structure extends in a longitudinal direction; and wherein the two first side faces and the two second side faces are radial end surfaces of the fin main body relative to the longitudinal direction.

2. The fin for a heat exchanger as claimed in claim 1, wherein a heat exchange tube can be put into the first recess from one side and can perform heat transfer with the fin main body.

3. The fin for a heat exchanger as claimed in claim 1, wherein a heat exchange tube can be put into the second recess from one side and can perform heat transfer with the fin main body.

4. The fin for a heat exchanger as claimed in claim 1, wherein a part of the fin main body which lies between the wave crest and wave trough has a waveform shape or has a window.

5. The fin for a heat exchanger as claimed in claim 1, wherein a part of the fin main body which lies between the wave crest and wave trough has a protrusion.

6. The fin for a heat exchanger as claimed in claim 1, wherein the fin main body comprises water drainage holes which penetrate edge parts of the plate and are formed at the wave crest and wave trough; the water drainage holes are formed on the second side faces.

7. The fin for a heat exchanger as claimed in claim 1, wherein the first direction and second direction are substantially perpendicular to each other, or the first side face and second side face are substantially perpendicular to each other.

8. A heat exchanger, comprising:

a heat exchanger assembly, comprising:

heat exchange tubes; and fins, the fin comprising a fin main body formed as a waveform structure from a plate; the fin main body has two first side faces which are opposite each other in a first direction, two second side faces which are opposite each other in a second direction, and a wave crest and a wave trough on the second side faces; moreover, the first direction and the second direction intersect each other; the fin main body comprises: first recesses, which are formed in the fin main body and located on the two first side faces of the fin main body, and a second recess, which is formed in the fin main body and located on at least one of the two second side faces of the fin main body;

wherein multiple heat exchange tubes and fins are arranged alternately in a row in such a way that first side faces of the fin main bodies of adjacent fins are adjacent to each other, thereby forming the heat exchanger assembly; the heat exchange tubes are located in the first recesses;

wherein the fin main body waveform structure extends in a longitudinal direction; and wherein the two first side faces and the two second side faces are radial end surfaces of the fin main body relative to the longitudinal direction.

9. The heat exchanger as claimed in claim 8, wherein another heat exchange tube is provided in the second recess of the fin of the heat exchanger assembly, on at least one of the two second side faces of the fin main body.

10. The heat exchanger as claimed in claim 8, wherein another heat exchange tube is provided between two heat exchanger assembly rows, the other heat exchange tube being located in the second recess.

11. The heat exchanger as claimed in claim 8, wherein the fin main body comprises: a plurality of second recesses, one of which is the second recess, which are formed in the fin main body and located on the two second side faces of the fin main body;

multiple heat exchanger assembly rows are arranged alternately with other heat exchange tubes located in the plurality of second recesses.

12. A heat exchanger, comprising:

a heat exchanger assembly, comprising:

heat exchange tubes; and fins, the fin comprising a fin main body formed as a waveform structure from a plate; the fin main body has two first side faces which are opposite each other in a first direction, two second side faces which are opposite each other in a second direction, and a wave crest and a wave trough on the second side faces; moreover, the first direction and the second direction intersect each other; the fin main body comprises: a first recess, which is formed in the fin main body and located on at least one of the two first side faces of the fin main body, and a second recess, which is formed in the fin main body and located on at least one of the two second side faces of the fin main body;

wherein multiple fins are arranged alternately in a row in such a way that second side faces of the fin main bodies of adjacent fins are adjacent to each other, and the heat exchange tube is located in the first recess on at least one of the two first side faces;

wherein the fin main body waveform structure extends in a longitudinal direction; and wherein the two first side faces and the two second side faces are radial end surfaces of the fin main body relative to the longitudinal direction.

13. The heat exchanger as claimed in claim 12, wherein the fin main body comprises: a plurality of second recesses, one of which is the second recess, which are formed in the fin main body and located on the two second side faces of the fin main body;

other heat exchange tubes are provided in the plurality of second recesses of the fin main bodies of the fins, such that fins and other heat exchange tubes are arranged alternately.

14. The heat exchanger as claimed in claim 12, wherein a heat exchange tube can be put into the first recess from one side and can perform heat transfer with the fin main body.

15. The heat exchanger as claimed in claim 12, wherein another heat exchange tube can be put into the second recess from one side and can perform heat transfer with the fin main body.

16. A fin for a heat exchanger, the fin comprising a fin main body formed as a waveform structure from a plate; the fin main body has two first side faces which are opposite each other in a first direction, two second side faces which are opposite each other in a second direction, and a wave crest and a wave trough on the second side faces; moreover, the first direction and the second direction intersect each other;

the fin main body comprises: a first recess, which is formed in the fin main body and located on at least one of the two first side faces of the fin main body; and second recesses, which are formed in the fin main body and located on the two second side faces of the fin main body;

wherein the fin main body waveform structure extends in a longitudinal direction; and wherein the two first side faces and the two second side faces are radial end surfaces of the fin main body relative to the longitudinal direction.

17. A heat exchanger, comprising:

a heat exchanger assembly, comprising:

heat exchange tubes; and fins, the fin comprising a fin main body formed as a waveform structure from a plate; the fin main body has two first side faces which are opposite each other in a first direction, two second side faces which are opposite each other in a second direction, and a wave crest and a wave trough on the second side faces; moreover, the first direction and the second direction intersect each other;

the fin main body comprises: a first recess, which is formed in the fin main body and located on at least one of the two first side faces of the fin main body; and second recesses, which are formed in the fin main body and located on the two second side faces of the fin main body;

wherein multiple heat exchange tubes and fins are arranged alternately in a row in such a way that second side faces of the fin main bodies of adjacent fins are adjacent to each other, thereby forming the heat exchanger assembly; the heat exchange tubes are located in the second recesses;

wherein the fin main body waveform structure extends in a longitudinal direction; and wherein the two first side faces and the two second side faces are radial end surfaces of the fin main body relative to the longitudinal direction.

18. The heat exchanger as claimed in claim 17, wherein the first recesses are located on the two first side faces of the fin main body; and multiple heat exchanger assembly rows are arranged alternately with other heat exchange tubes located in the first recesses.

* * * * *